US008232931B2

(12) United States Patent
Wacyk et al.

(10) Patent No.: US 8,232,931 B2
(45) Date of Patent: Jul. 31, 2012

(54) AUTO-CALIBRATING GAMMA CORRECTION CIRCUIT FOR AMOLED PIXEL DISPLAY DRIVER

(75) Inventors: Ihor Wacyk, Briarcliff, NY (US); Olivier Prache, Pleasntville, NY (US)

(73) Assignee: eMagin Corporation, Hopewell Junction, NY (US)

( * ) Notice: Subject to any disclaimer, the term of this patent is extended or adjusted under 35 U.S.C. 154(b) by 1821 days.

(21) Appl. No.: 11/402,092

(22) Filed: Apr. 10, 2006

(65) Prior Publication Data

US 2007/0236419 A1 Oct. 11, 2007

(51) Int. Cl.
*G09G 3/30* (2006.01)

(52) U.S. Cl. ..... 345/76; 345/77; 345/204

(58) Field of Classification Search ..... 345/77, 345/76, 78, 82

See application file for complete search history.

(56) References Cited

U.S. PATENT DOCUMENTS

| | | | | |
|---|---|---|---|---|
| 4,948,983 | A * | 8/1990 | Maruyama et al. | 250/548 |
| 2001/0035850 | A1 * | 11/2001 | Okamoto et al. | 345/77 |
| 2003/0234754 | A1 | 12/2003 | Abe et al. | |
| 2004/0021653 | A1 | 2/2004 | Kim et al. | |
| 2004/0032217 | A1 | 2/2004 | Abe et al. | |
| 2004/0070558 | A1 * | 4/2004 | Cok et al. | 345/76 |
| 2005/0253530 | A1 * | 11/2005 | Feldman et al. | 315/169.3 |
| 2006/0015272 | A1 * | 1/2006 | Giraldo et al. | 702/58 |
| 2006/0208671 | A1 * | 9/2006 | Ozaki et al. | 315/371 |

* cited by examiner

*Primary Examiner* — William Boddie
*Assistant Examiner* — Leonid Shapiro
(74) *Attorney, Agent, or Firm* — Robert L. Epstein; Epstein Drangel LLP

(57) ABSTRACT

A drive circuit is provided for an OLED in a pixel array. The circuit includes input voltage signal receiving means. Output voltage signal generating means are operably connected to the pixel diode. Means are provided for processing the input voltage signal to replicate the inverse IV characteristic of the pixel diode, to form the output voltage signal.

7 Claims, 4 Drawing Sheets

AUTO-CALIBRATING GAMMA CORRECTION CIRCUIT FOR AMOLED PIXEL DISPLAY DRIVER

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A "SEQUENCE LISTING", A TABLE, OR A COMPUTER PROGRAM LISTING APPENDIX SUBMITTED ON COMPACT DISC

Not Applicable

BACKGROUND OF THE INVENTION

1. Field of the Invention

The present invention relates to a circuit for providing a voltage signal to drive the organic light emitting diodes (OLEDs) in a pixel array display and more particularly to such a driver circuit that automatically compensates for the nonlinear voltage to luminance behavior of the pixel OLEDs due to temperature and process variability inherent in the OLED manufacturing process.

2. Description of Prior Art Including Information Disclosed Under 37 CFR 1.97 and 1.98

Pixel drivers can be configured as either current sources or voltage sources to control the amount of light generated by the OLEDs in an active matrix display. AMOLED microdisplays require very low amounts of current to generate light, especially when using analog gray scale rendition techniques. OLEDs have typically been driven in current mode due to the linear dependence of luminance on operating current. For low light level applications, a typical OLED microdisplay pixel current is about 200 pA. Traditionally, a long channel transistor is used to generate the output current. Realizing a compact circuit that can fit in a microdisplay application precludes the use of very long channel transistors.

The relationship between the current in an OLED diode and the voltage across the diode is known as its IV characteristic. The OLED current, I, is equal to a non-linear function of the voltage across the diode, V, and can be expressed in general as $I=f(V)$.

The inverse IV characteristic of the OLED diode is expressed as $I=f^{-1}(V)$ where $f^{-1}$ is a function that can be used to linearize the normal OLED IV characteristic. Using well known mathematical principles, the normal and inverse IV characteristics are related by the expression $I=k*V=f^{-1}(f(V)$ where k is a constant.

Driving OLEDs in voltage mode, on the other than, has not been used in the past due to the nonlinear voltage to luminance behavior of the OLED which varies under different operating conditions. For example, the shape of the nonlinear IV characteristic will change form one display to the next due to variability in the OLED manufacturing process. The operating temperature will introduce another variability in the OLED IV characteristic which has to be taken into account during normal operation of the microdisplay. Finally, the operating voltage range of the OLED, which is used to control the average brightness of the display, will also change the shape of the required gamma curve.

A significant benefit of the voltage drive mode is the ability to miniaturize the pixel cell while still providing good control for low light applications. Very long channel transistors are not required as the drive transistor can be operated as a voltage source with good pixel to pixel uniformity. Miniaturization is a key drive to reduce the cost of AMOLED microdisplays and provides a strong incentive to implement a voltage mode of operation for next generation products. To achieve this goal, however, the problem of the variable gamma correction has to be solved.

The techniques published by OLED display designers mostly address direct view displays (displays having a diagonal greater than 2" typically) using non-crystalline silicon processes. Those techniques were primarily developed to address the high threshold voltage variability inherent to the processes. Because of the relative large display size (when compared to microdisplays), there is no need for very low current operation and therefore none of these displays make use of the subthreshold region.

The threshold voltage compensation techniques described in the literature are of two types:

- Voltage based compensation using a second storage capacitor to store the threshold voltage at each pixel
- current based compensation using a technique similar to that first developed in the eMagin Corporation SVGA+ microdisplay as described in O. Prache, "Full-color SVGA+OLED-on-silicon microdisplay", Journal of the SID, pp 133-138, 2002.

The implementation that we are aware of that is closest to the present invention is a design from Hitachi, described in the SID symposium Proceedings of 2002, 2003 and 2004. It uses a voltage compensated pixel cell and a ramp applied to the storage element via the data line.

The primary objective of the present invention is to achieve an accurate gamma function for a voltage driven AMOLED microdisplay that is independent of manufacturing variability and operational conditions. This will allow miniaturization of the pixel structure and a size reduction of the overall microdisplay area. This invention is also applicable to larger format displays that use an active matrix architecture. The benefit is a less expensive device with improved image quality that is required for large volume application.

It is not possible to build a fixed gamma correction function into the microdisplay that can compensate for the nonlinear voltage to luminance behavior of the OLED display under all operating conditions. The nonlinear characteristic of the OLED varies from one display to all the next due to process variability and within the display due to changes in operating conditions such as temperature and bias.

In general, the present invention achieves its objective by using a Gamma reference circuit to create an output voltage signal to drive the OLED diodes into the matrix OLED display that replicates the inverse IV characteristic of the OLED device. The circuit compensates for the dependency on temperatures and process variability of the Gamma curve.

More specifically, the present invention employees an adaptive gamma correction scheme. A spare OLED diode is provided in the microdisplay which serves as a reference device for the gamma correction function. The OLED reference diode is configured to operate under the same bias and temperature conditions as the pixel diodes, but in the reverse mode. That is, a current proportional to the input signal is fed into the OLED reference device, and the voltage at the anode node provides the resulting output signal. In the pixel array, on the other hand, the input or drive signal is a voltage applied to the anode of the OLED diode and the resulting current is the output signal. The transfer function formed by the input to output signals across the spare OLED device provides the desired gamma function needed to achieve a linear input signal to output current relationship.

Since both the reference and pixel OLED devices are formed at the same time in the display, the IV characteristics will match to a high degree of accuracy. Also, the diode in the reference circuit will operate at the same current density as the pixel device because they are both tied to a common cathode voltage via the same VCOMMON line. This assures that the reference and pixel OLED devices always have the same bias conditions. As a result, as the temperature and bias conditions change for a particular microdisplay, the gamma correction function created from the reference diode will adapt its shape and will continue to produce a perfect match for the diodes used in the pixel array.

BRIEF SUMMARY OF THE INVENTION

It is, therefore, a prime object of the present invention to provide an auto-calibrating gamma correction circuit for an OLED pixel array.

It is another object of the present invention to provide such a drive circuit that automatically compensates for the nonlinear voltage to luminance behavior of the pixel array OLEDs due to temperature and process variability inherent in the OLED manufacturing process.

It is another object of the present invention to provide a drive circuit for an OLED in a pixel array that includes input voltage signal receiving means, output voltage signal generating means operably connected to the pixel diode and means for processing the input voltage signal to replicate the inverse IV characteristic of the pixel diode, to form the output voltage signal.

It is another object of the present invention to provide a drive circuit for an OLED in a pixel array including means for applying a current proportional to the input voltage signal to the reference diode and means for applying the output voltage signal to the pixel diode.

In accordance with the present invention, a drive circuit is provided for an OLED in a pixel array. The circuit includes input voltage signal receiving means. Output voltage signal generating means are operably connected to the pixel diode. Means are provided for processing the input voltage signal to replicate the inverse IV characteristic of the pixel diode, to form the output voltage signal.

A reference diode is provided. Means are provided for applying a current proportional to the input voltage signal to the reference diode. Means are also provided for applying the output voltage signal to the pixel diode.

The processing means includes first processing means for converting the input voltage signal into an output current. The processing means also includes second processing means operably connected to receive the output current from the first processing means and for converting same into the output voltage signal. The reference diode operates under the same bias voltage and temperature conditions as the pixel diode, but in the reverse mode.

The first processing means includes an operational amplifier having first and second inputs and an output. The first input of the operational amplifier is connected to receive the input voltage signal. A first transistor with a control electrode and an output circuit is included as part of the first processing means. The control electrode of the first transistor is connected to the output of the operational amplifier. A resistor is also included in the first processing means. The output circuit of the first transistor is connected between a voltage source and a first node. The resistor is interposed between the first node and ground. The second input of the operational amplifier is connected to the first node.

The second processing means includes a second transistor having a control electrode and an output circuit. The control electrode of the second transistor is connected to the output of the operational amplifier. The output circuit of the second transistor is connected between a voltage source and a second node. The processing means also includes the reference diode. The reference diode is connected between the second node and the bias voltage for the pixel diode. The second node is operably connected to the pixel diode to provide the output voltage signal thereto.

The processing circuit of the present invention may be used with a unity gain voltage buffer operably connected to receive the output voltage signal from the circuit. Capacitor means operably connected to the output of the buffer may be provided to store the output voltage signal.

A Piece-Wise Linear function generator means may be provided for use with the processing circuit. Means may be provided for connecting the processing circuit of the present invention to the generator means to provide its PWL coefficients.

BRIEF DESCRIPTION OF THE SEVERAL VIEWS OF DRAWINGS

To these and to such other objects that may hereinafter appears, the present invention relates to auto-calibrating gamma correction circuit for AMOLED pixel display driver as described in detail in the following specification and recited in the annexed claims, taken together with the accompanying drawings, in which like numerals refer to like parts and in which:

DETAILED DESCRIPTION OF THE INVENTION

Figure 2:
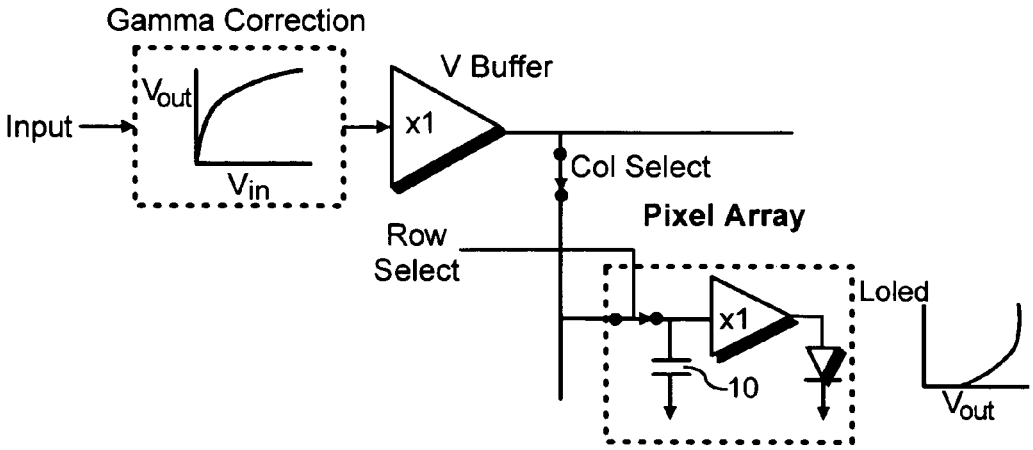
FIG. 2 is a block diagram of the voltage drive architecture using the circuit of the present invention.

As depicted in FIG. 2, the input signal is an analog waveform containing the video to be displayed on the pixel array matrix. It has been stripped of synchronization and other control information which is used separately to ensure the appropriate sequencing of the ROW and COLUMN select pulses. The sequencing is used for application of video data to the pixel array in a raster pattern.

Figure 1:
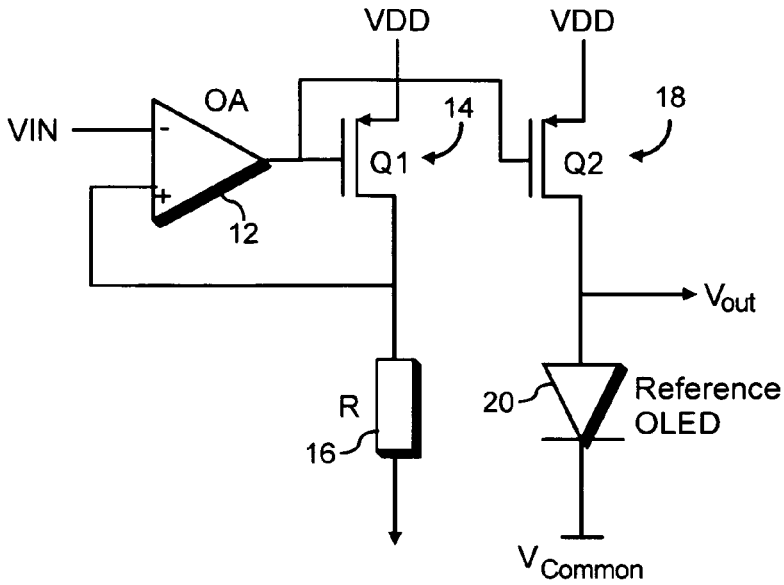
FIG. 1 is a schematic design of the driver circuit of the present invention.

As the input signal (Vin) passes through the Gamma Correction Circuit it is modified according to the nonlinear transfer function of the circuit shown in FIG. 1. The corrected signal (Vout) is buffered by a unity gain voltage buffer (V Buffer) in order to drive the total parasitic load capacitance of the column line within the allotted write cycle time. A copy of the output signal (Vout) is stored in the selected pixel storage capacitor 10. A unity gain buffer stage in the pixel forces the anode of the OLED to the Vout level and maintains this level until it is updated in the next write cycle. The OLED current is a nonlinear function of its voltage level. However, since the gamma correction function is an exact inverse of the OLED function, the final operating OLED current will be linearly dependent on the input signal.

The Gamma correction OLED pixel drive circuit of the present invention is illustrated in FIG. 1. The input signal (Vin) is applied to the negative input of an operational amplifier 12. The output of operational amplifier 12 drives the gate of a first pmos transistor 14 so that the voltage across the resistor 16, connected between the output circuit of transistor 14 and ground, is essentially equal to the input signal (Vin). As a consequence, the current flowing through the resistor 16 will be equal to Vin/R. As the input voltage (Vin) changes, the gate voltage across transistor 14 will track to maintain a current through transistor 14 that is linearly dependent on the input voltage (Vin).

The gate voltage at transistor 14 is simultaneously applied to the second pmos transistor 18. If the dimensions of transistor 18 (width and length) are identical to those of transistor 14, then the same current will flow through both devices. This ensures that the current through the OLED reference device 20, will be linearly dependent on the input signal (Vin) as scaled by the resistence R of resistor 16. The resistence R of resistor 16 is chosen to ensure that the current density through the reference OLED device 20 is the same as the pixel OLED for the chosen control range of the input voltage (Vin). The output voltage (Vout) is the voltage across the pixel OLED (not shown) that corresponds to its current level as determined by its nonlinear IV characteristic. Reference OLED device 20 is connected between the output circuit of transistor 18 and the bias voltage (V COMMON) for the pixel OLEDs.

As a result, the Vout/Vin transfer function for the processing circuit of FIG. 1 is exactly the inverse of the pixel OLED current to voltage relationship. Since the Gamma correction function and the OLED drive function are obtained from devices on the same chip, under similar operating conditions, the final linearity of the composite signal is well matched.

Figure 3:
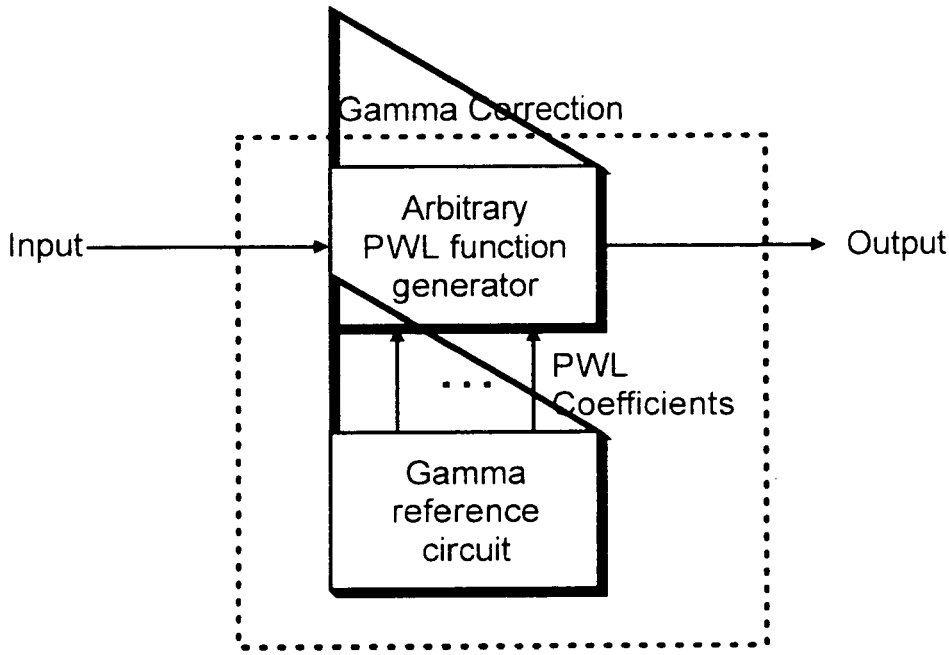
FIG. 3 is a gamma correction block diagram.

The Gamma reference circuit by itself will not provide sufficient speed to drive the column array due to its low operating current and consequent low bandwidth. To overcome this limitation, the circuit can be included in a high-speed feedback loop or it may be used as a static reference for an approximately equivalent nonlinear circuit, as shown in FIG. 3. An arbitrary Piece-Wise Linear function generator provides the gamma correction functionality to a degree of accuracy determined by the number of linear segments used. Each linear segment is defined by its PWL coefficients (breakpoint and slope). In this manner, the Gamma reference circuit is used only to generate the PWL coefficients, which can be done as slowly as needed as these are effectively DC parameters.

Figure 4:
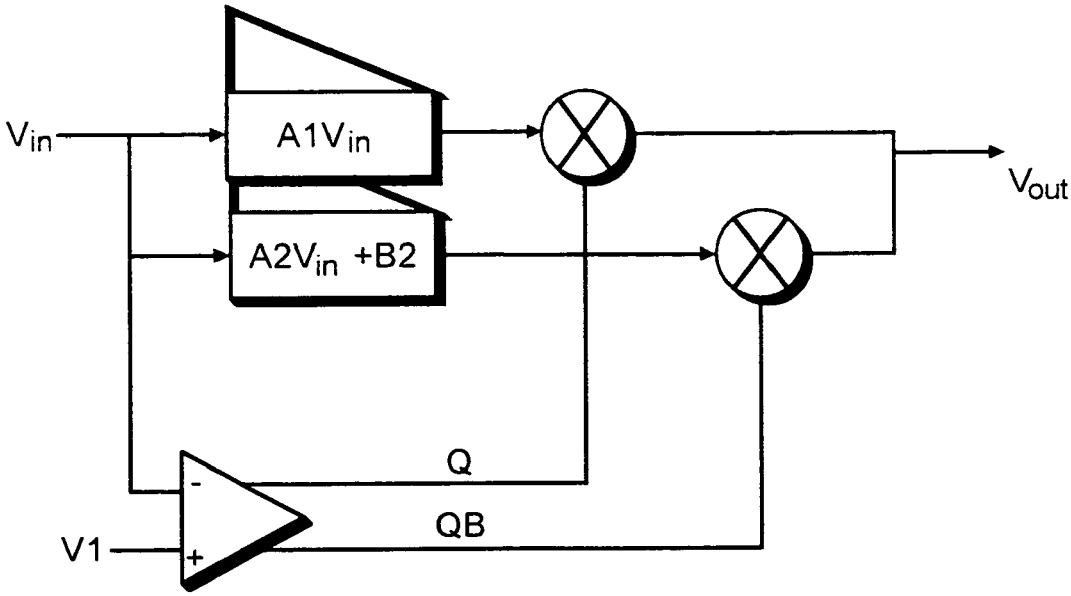
FIG. 4 is a schematic diagram of a two segment implementation of an arbitrary PWL generator.

An example of a two-segment PWL function implementation is given in FIG. 4 to illustrate the basic principle. The coefficients V1, A1, and B2 are DC values which are easily provided by the Gamma reference circuit in combination with standard operational function blocks. These parameters set the slopes and intercepts of the two gain blocks which form the two linear segments shown on the right in the Figure.

The input signal is compared to the first breakpoint V1 by the comparator which controls a pair of transmission gates. If VIN is less than V1, then the top transmission gate is closed and the bottom one is open, allowing the signal from the top gain block to appear at the output. When the input exceeds V1, the comparator reverses the states of the transmission gates and allows the signal from the lower gain block to pass to the output. This approach can be easily expanded to form a PWL function with any desired number of segments. Many other circuit implementations are possible and do not affect the intended functionality of the invention.

Figure 5:
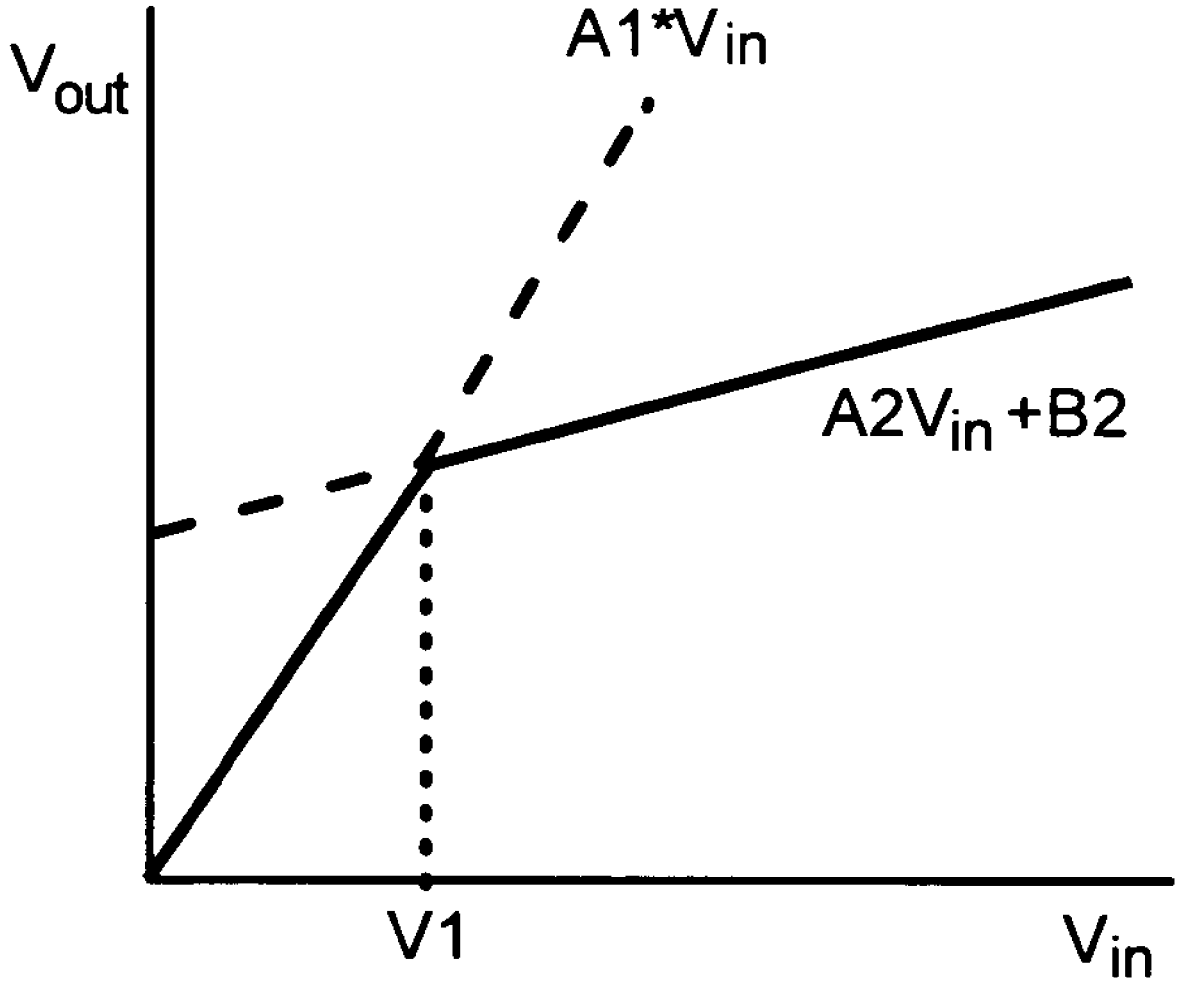
FIG. 5 is a graphic representation of the relationship between the voltage input signal and voltage output signal for the circuit of FIG. 4.
Figure 6:
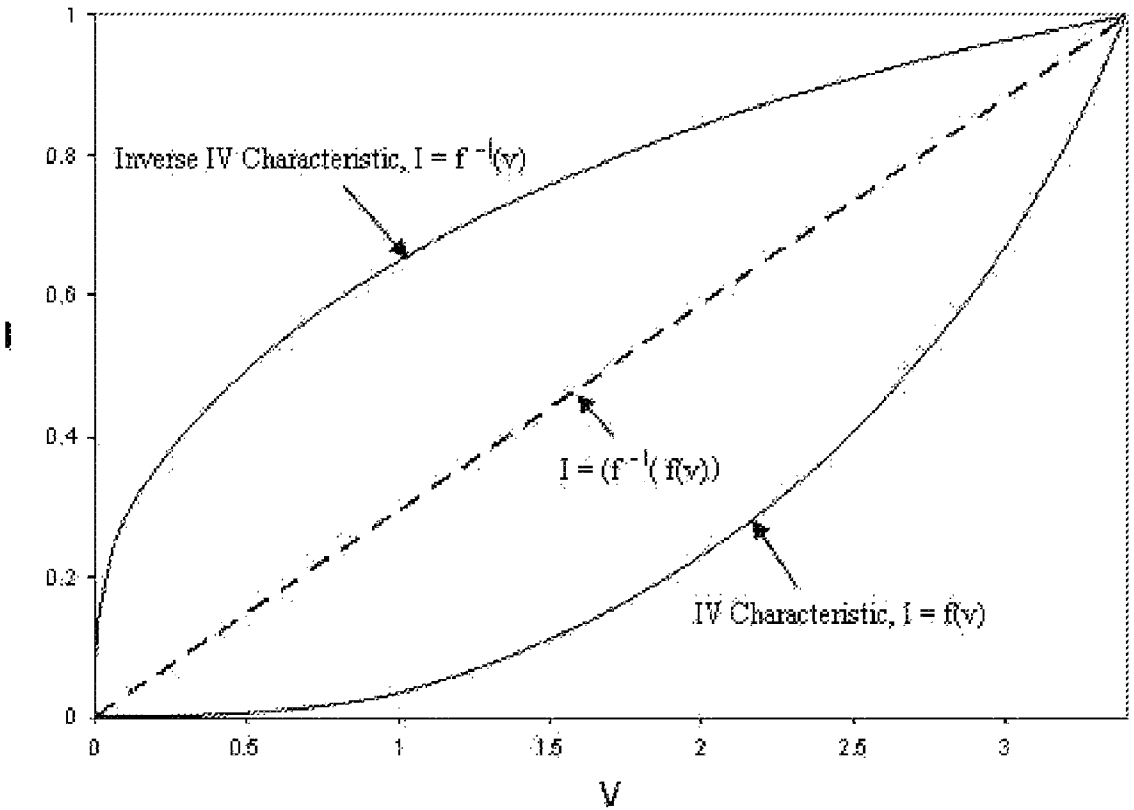
FIG. 6 is a graphic representation of the relationship between the normal IV characteristic and the inverse IV characteristic.

FIG. 5 is a graphic representation of the relationship between the voltage input signal and voltage output signal for the circuit of FIG. 4.

While only a limited number of preferred embodiments of the present invention have been disclosed for purposes of illustration, it is obvious that many modifications and variations could be made thereto. It is intended to cover all of those modifications and variations which fall within the scope of the present invention, as defined by the following claims:

We claim:

1. A drive circuit for an organic light omitting diode (OLED) in a pixel array comprising:

input voltage signal receiving means, output voltage signal generating means operably connected to the pixel diode, and means for processing said input voltage signal to replicate the inverse IV characteristic of the pixel diode, to form said output voltage signal;

wherein said processing means comprises first means for converting said input voltage signal into an output current; and wherein said processing means further comprises second means operably connected to receive said output current from said first means and for converting same into said output voltage signal, said second means comprising a reference diode, means for applying a current proportional to said input voltage signal to said reference diode and means for applying said output voltage signal to the pixel diode, said means for applying a current proportional to said input voltage signal to the pixel diode comprising a transistor having a gate and an output circuit, said gate being adapted to receive said output current from said first means, said output circuit of said transistor being operably connected to said reference diode through a node such that said output voltage signal appears at said node.

2. The circuit of claim 1 wherein said reference diode operates under the same bias voltage and temperature conditions as the pixel diode, but in the reverse mode.

3. The circuit of claim 1 further comprising unity gain voltage buffer means operably connected to receive said output voltage signal.

4. The circuit of claim 3 further comprising capacitor means operably connected to the output of said buffer means to store said output voltage signal.

5. A drive circuit for an organic light omitting diode (OLED) in a pixel array comprising:

input voltage signal receiving means, output voltage signal generating means operably connected to the pixel diode, and means for processing said input voltage signal to replicate the inverse IV characteristic of the pixel diode, to form said output voltage signal;

wherein said processing means comprises first means for converting said input voltage signal into an output current; and wherein said first means comprises operational amplifier means having first and second inputs and an output, said first input being connected to receive said input voltage signal, a first transistor comprising a control electrode and an output circuit, said control electrode of said first transistor being connected to said output of said operational amplifier, a resistor, said first transistor output circuit being connected between a voltage source and a first node, said resistor being interposed between said first node and ground, said second input of said operational amplifier being connected to said first node.

6. A drive circuit for an organic light omitting diode (OLED) in a pixel array comprising:

input voltage signal receiving means, output voltage signal generating means operably connected to the pixel diode, and means for processing said input voltage signal to replicate the inverse IV characteristic of the pixel diode, to form said output voltage signal;

wherein said processing means comprises first means for converting said input voltage signal into an output current;

wherein said processing means further comprises second means operably connected to receive said output current from said first means and for converting same into said output voltage signal, said second means comprising a reference diode, operating under the same bias voltage and temperature conditions as the pixel diode, but in the reverse mode; and wherein said first means comprises operational amplifier means having first and second inputs and an output, said first input being connected to receive said input voltage signal, a first transistor comprising a control electrode and an output circuit, said control electrode of said first transistor being connected to said output of said operational amplifier, a resistor, said first transistor output circuit being connected between a voltage source and a first node, said resistor being interposed between said first node and ground, said second input of said operational amplified being connected to said first node.

7. The circuit of claim 6 wherein said second means comprises a second transistor having a control electrode and an output circuit, said control electrode of said second transistor being connected to said output of said operational amplified and said output circuit of said second transistor being connected between a voltage source and a second node, said reference diode being connected between said second node and the bias voltage for the pixel diode, said second node being operably connected to the pixel diode to provide said output voltage signal thereto.

* * * * *